US012404765B1

(12) United States Patent
Kalwar et al.

(10) Patent No.: US 12,404,765 B1
(45) Date of Patent: Sep. 2, 2025

(54) SAND BAILER AND LEAD IMPRESSION BLOCK COMBINATION FOR DOWNHOLE SAMPLE COLLECTION AND OBSTRUCTION DIAGNOSIS

(71) Applicant: SAUDI ARABIAN OIL COMPANY, Dhahran (SA)

(72) Inventors: Ghulam Murtaza Kalwar, Udhailiyah (SA); Abdulaziz M Sagr, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/592,133

(22) Filed: Feb. 29, 2024

(51) Int. Cl.
*E21B 47/098* (2012.01)
*E21B 27/00* (2006.01)
*E21B 34/14* (2006.01)

(52) U.S. Cl.
CPC ..... *E21B 47/098* (2020.05); *E21B 27/00* (2013.01); *E21B 34/142* (2020.05); *E21B 2200/04* (2020.05); *E21B 2200/05* (2020.05)

(58) Field of Classification Search
CPC ..... E21B 47/098; E21B 27/00; E21B 31/08
See application file for complete search history.

(56) References Cited

U.S. PATENT DOCUMENTS 702,653 A 6/1902 Jackson
1,832,323 A 11/1931 Rigby
1,843,217 A * 2/1932 Fletcher ..... E21B 27/00 166/109
2,166,489 A 7/1939 Gates
(Continued)

FOREIGN PATENT DOCUMENTS

CN 109505550 A * 3/2019 ..... E21B 27/00
CN 118128523 A * 6/2024
(Continued)

OTHER PUBLICATIONS

Brio-Tech Pressure Controls Inc., "Hydrostatic Bailer"; <https://brio-techpce.com/wp-content/uploads/2023/08/Hydrostatic-Bailer-Brio-Tech-Catalog-revised-1.01-s-3-NEW.pdf>; Accessed Feb. 28, 2024 (1 page).
(Continued)

*Primary Examiner* — Jennifer H Gay
(74) *Attorney, Agent, or Firm* — Osha Bergman Watanabe & Burton LLP

(57) ABSTRACT

An apparatus includes a sand bailer and a lead impression block. The sand bailer is configured to be disposed in the tubular and obtain a sample of the obstruction. The sand bailer includes a piston movably disposed in a cavity of a barrel and a valve connected to a downhole end of the barrel and configured to control hydraulic communication between an orifice of a hollow body of the valve and a cavity of the barrel by opening and closing. The piston is configured to create a suction pressure in the cavity of the barrel to open the valve and retrieve the sample of the obstruction into the cavity and wherein the valve is configured to close to hold the sample of the obstruction in the cavity of the barrel. The lead impression block is connected to the hollow body of the valve in the sand bailer. The lead impression block is configured to set against the obstruction, using the sand bailer, and obtain an impression of the obstruction.

14 Claims, 3 Drawing Sheets

(56) References Cited

U.S. PATENT DOCUMENTS

| | | | | |
|---|---|---|---|---|
| 2,191,223 | A | 2/1940 | Van Stone et al. | |
| 2,399,844 | A * | 5/1946 | Alkire | E21B 27/00 166/113 |
| 2,454,945 | A | 11/1948 | Reynolds | |
| 2,689,534 | A * | 9/1954 | Mack | E21B 27/00 92/240 |
| 2,824,378 | A * | 2/1958 | Stokes | E21B 47/098 73/152.01 |
| 2,992,682 | A * | 7/1961 | Yates | E21B 27/00 166/107 |
| 5,163,515 | A * | 11/1992 | Tailby | E21B 23/08 166/383 |
| 5,944,100 | A * | 8/1999 | Hipp | E21B 31/06 166/99 |
| 6,041,860 | A | 3/2000 | Nazzal et al. | |
| 8,307,895 | B2 * | 11/2012 | Lund | E21B 47/098 33/561.1 |
| 11,965,414 | B2 * | 4/2024 | Nafa | E21B 17/042 |
| 12,024,994 | B1 * | 7/2024 | Alsulaim | E21B 47/006 |
| 2002/0174987 | A1 * | 11/2002 | Hoffman | E21B 23/04 166/99 |
| 2010/0212890 | A1 * | 8/2010 | Lund | E21B 31/00 73/152.01 |
| 2016/0102527 | A1 * | 4/2016 | Manson | E21B 41/00 166/243 |
| 2023/0082225 | A1 * | 3/2023 | Nafa | E21B 17/042 166/250.01 |

FOREIGN PATENT DOCUMENTS

| | | | |
|---|---|---|---|
| EP | 2 780 536 | A1 | 9/2014 |
| GB | 811259 | A | 4/1959 |

OTHER PUBLICATIONS

LiMAR Well Intervention Products UK, "Hydrostatic Bailer—Flapper Type"; <https://www.limaroiltools.com/assets/pdfs/wireline/2021/05/17/78a866b6-e53f-4b96-849c-d02372ea21f2.pdf?v=1&name=1086%20-%20Hydrostatic%20Bailer%20%E2%80%93%20Flapper%20Type.pdf>; Accessed Feb. 28, 2024 (2 pages).

LiMAR Well Intervention Products UK, "Hydrostatic Bailer—Ball Type"; <https://www.limaroiltools.com/assets/pdfs/wireline/2021/05/17/788b4252-e8c6-4062-bb49-59394a9109bf.pdf?v=1&name=1015%20-%20Hydrostatic%20Bailer%20%E2%80%93%20Ball%20Type.pdf>; Accessed Feb. 28, 2024 (2 pages).

Western Pressure Controls Ltd, "Hydrostatic Bailer"; <https://westernpressure.com/product_images/import/schematics/K1.250HB00.pdf>; Accessed Feb. 28, 2024 (2 pages).

Peak Well Systems, "Hydrostatic Bailer"; Oct. 9, 2020; <https://www.peakwellsystems.com/media/228513/114_hydrostatic_bailer_pws_dsheet.pdf>; Accessed Feb. 28, 2024 (1 page).

Dedicated To Intervention, "Hydrostatic Bailer"; <https://dti.uk.com/Slickline/Bailers/hydrostatic-type-bailer>; Accessed Feb. 28, 2024 (2 pages).

Hunting PLC, "Hydrostatic Bailers"; <https://cdn.sanity.io/files/bwa44qrg/production/38c9fcbf6cfd63dcfdeab741c404cef81b0136fe.pdf>; Accessed Feb. 28, 2024 (1 page).

Brace Tool Inc., "Hydrostatic Bailer"; <https://assets-global.website-files.com/65144f2ab86f0c7800beb8f9/6524756d0d07465bb4ebaca0_913d9f2992e3463c90494357e98588fd.pdf>; Accessed Feb. 28, 2024 (2 pages).

Elmartm, "ElmarTM Tools Wireline & Flow Control Products"; <https://edge.sitecorecloud.io/nationaloil37c5-novinc-prod-e309/media/nov/files/products/caps/intervention-and-stimulation-equipment/slickline-tools-and-flow-control/elmar-wireline-tools-catalog.pdf>; pp. 35; Accessed Feb. 28, 2024 (1 page).

Weatherford International, "BDK Intervention Products"; <https://www.weatherford.com/documents/catalog/bdk-intervention-products-catalog/>; pp. 18; Accessed Feb. 28, 2024 (1 page).

"Lead Impression Block" [Product Catalog]. Innovex; 2022. Accessed Jan. 6, 2025; <https://www.innovex-inc.com/wp-content/uploads/Lead-Impression-Blocks.pdf (Year: 2022) (1 page).

Office Action issued in corresponding U.S. Appl. No. 18/592,233; dated Feb. 6, 2025 (19 pages).

"Hydrostatic Bailer" [Product Catalog]. BDK Intervention Products; 2019. Accessed Jan. 6, 2025; https://www.weatherford.com/documents/catalog/bdk-intervention-products-catalog/ (Year: 2022) (288 pages).

* cited by examiner

SAND BAILER AND LEAD IMPRESSION BLOCK COMBINATION FOR DOWNHOLE SAMPLE COLLECTION AND OBSTRUCTION DIAGNOSIS

BACKGROUND

In the oil and gas industry, hydrocarbons are located in porous rock formations beneath the Earth's surface. Hydrocarbons are accessed by drilling wells into the formation(s). A well is a series of concentric holes drilled into the surface of the Earth where each hole is supported by a casing string cemented in place. In order to produce the hydrocarbons, a production string is often run and set within the inner-most casing string. A production string is a series of tubulars connected to one another. The production string is used to provide a conduit for hydrocarbon migration to the surface. Often, other production equipment, such as pumps and separators, are included in the production string to aid production of the hydrocarbons.

During the life of a well, the well may require one or more wellbore interventions to maintain the well, secondarily complete the well, or replace downhole equipment. These wellbore interventions may be run directly in the interior casing string, with the production tubing removed from the well, or the wellbore interventions may require through-tubing access to the well. Through-tubing access is a method that includes running tools through the inside of the production tubing to perform operations downhole.

Prior to running tools into the well, a drifting operation may be performed to ensure that the tools may fit in the tubular though which they will be deployed, whether that be the casing string or production tubing. Drifting conventionally consists of running a tool, having a diameter assumed to be the accessible inner diameter of the inner-most tubular, through the inside of the tubular to determine the wellbore accessibility. Occasionally, the drifting tool is unable to be run through the entirety of the tubular due to obstructions.

An obstruction may be a signal of a potential tubular collapse, broken off tools, or solids accumulation (e.g., sand, gravel, debris, loose fill). Identification of an obstruction is difficult due to the decreased visibility, harshness, and depth of the downhole environment. Thus, once an obstruction is identified, a lead impression block or a bailer may be run to try to identify the extent, size, or make-up of the obstruction.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and apparatuses for detecting an obstruction in a tubular. The apparatus includes a sand bailer and a lead impression block. The sand bailer is configured to be disposed in the tubular and obtain a sample of the obstruction. The sand bailer includes a piston movably disposed in a cavity of a barrel and a valve connected to a downhole end of the barrel and configured to control hydraulic communication between an orifice of a hollow body of the valve and a cavity of the barrel by opening and closing. The piston is configured to create a suction pressure in the cavity of the barrel to open the valve and retrieve the sample of the obstruction into the cavity and wherein the valve is configured to close to hold the sample of the obstruction in the cavity of the barrel. The lead impression block is connected to the hollow body of the valve in the sand bailer. The lead impression block is configured to set against the obstruction, using the sand bailer, and obtain an impression of the obstruction.

The method includes running an apparatus, comprising a lead impression block connected to a sand bailer using a valve, to a location adjacent to an obstruction in the tubular, lowering the apparatus onto the obstruction to compress a piston located in a barrel of the sand bailer and obtain an impression of the obstruction on the lead impression block, and pulling the apparatus off of the obstruction to cause the piston to stroke and create a suction pressure in a cavity of the barrel to open the valve. The method further includes retrieving a sample of the obstruction from the tubular, through the valve, and into the cavity of the barrel using the suction pressure, holding the sample of the obstruction in the cavity of the barrel using the valve, and pulling the apparatus from the tubular to analyze the sample and the impression of the obstruction.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
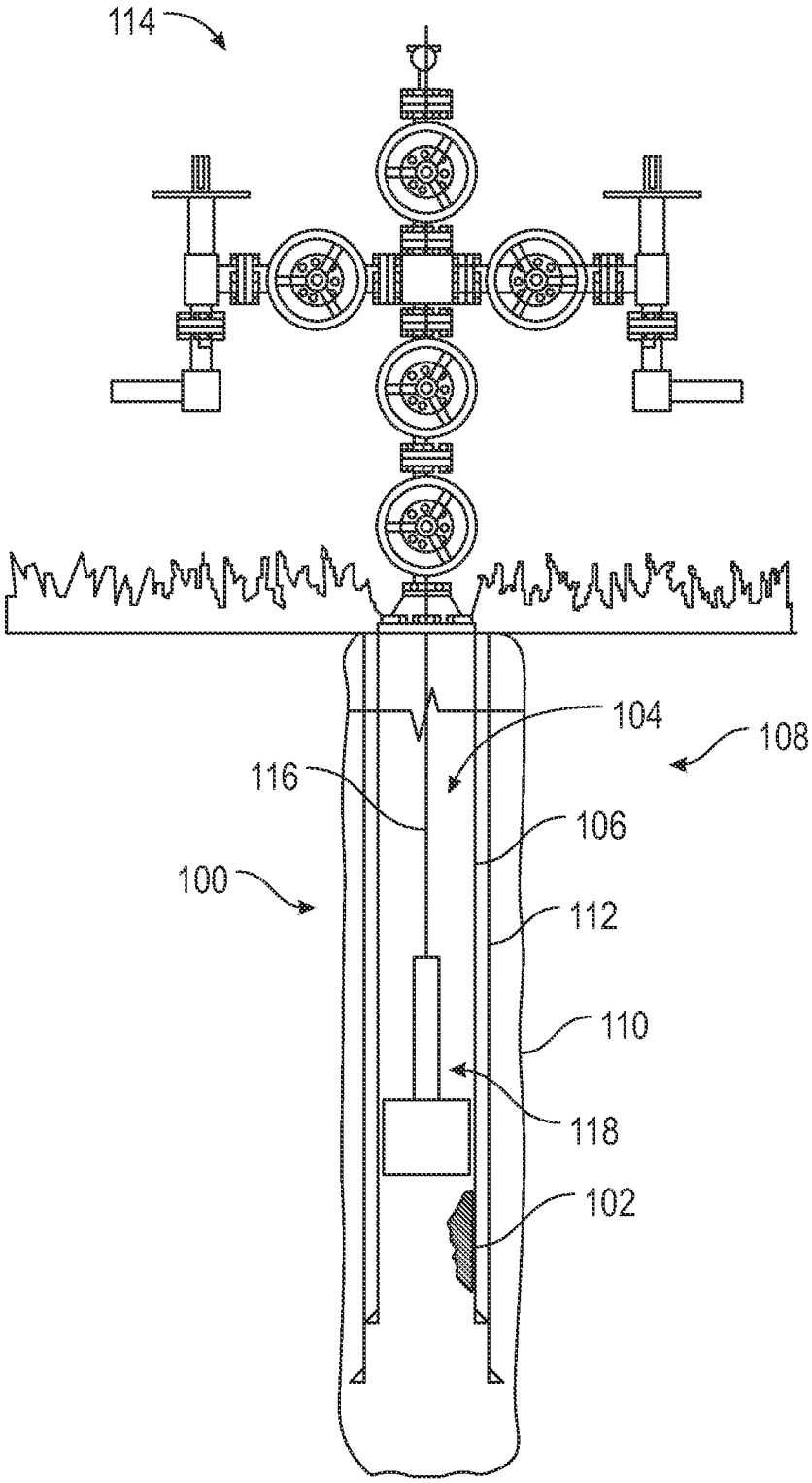
FIG. 1 shows a schematic cross-sectional view illustrating a system for detecting an obstruction in a conduit of a tubular located in a well in accordance with one or more embodiments.

FIG. 1 shows a schematic cross-sectional view illustrating a system (100) for detecting an obstruction (102) in a conduit (104) of a tubular (106) located in a well (108) in accordance with one or more embodiments. The well (108) shown in FIG. 1 is shown for exemplary purposes and is not meant to be limiting. A person skilled in the art will appreciate that a well having any type of surface equipment, well schematic, design, or trajectory may be used herein without departing from the scope of the disclosure.

In accordance with one or more embodiments, the well (108) includes a wellbore (110) drilled into the surface of the Earth. A casing string (112) is cemented in place in the wellbore (110). A tubular (106) is disposed within the casing string (112). The tubular (106) may be a production string or an inner casing string deployed inside an outer casing string (112) without departing from the scope of the disclosure herein.

The well (108) further includes a production tree (114) housing the surface-extending portion of the casing string (112) and the surface-extending portion of the tubular (106). The production tree (114) is a series of spools and valves that are used to enable production of fluids from the well (108) and enable downhole access to the well (108). Herein, the term "production tree (114)" may encompass the wellhead, casing head(s), and the tubing head without departing from the scope of the disclosure herein. Ther may be other equipment on the surface associated with the operation being performed on the well (108) without departing from the scope of the disclosure herein.

The system (100) includes a deployment device (116) connected to an apparatus (118). The deployment device (116) is used to raise and lower the apparatus (118) inside of the tubular (106). The deployment device (116) may be any type of deployment device known in the art, such as coiled tubing, slickline, or wireline. An input may direct the deployment device (116) to extend the apparatus (118) further into the tubular (106) or retract the apparatus (118) further out of the tubular (106). Surface equipment associated with the deployment device (116) is not shown, but a person skilled in the art will appreciate that the equipment needed to operate the deployment device (116) would be present at the well site.

The obstruction (102) may be any type of obstruction known in the art and may be located at any depth within the well (108). For example, the obstruction (102) may be encountered at shallower-than-inflow-zone depths, such as at the top of perforations, sand screens, frac ports, etc. The obstruction (102) may be caused by solids accumulation (e.g., sand, gravel, scale, debris, other loose fill), or the obstruction (102) may be caused by mechanical issues (e.g., tubing/casing collapse, completion equipment failure, liner deformation, etc.). The obstruction (102) may also be encountered due to settling of debris above temporarily installed downhole equipment (e.g., plug, memory gauges, etc.). In such scenarios, the obstruction (102) may prevent the recovery of that equipment through conventional operations.

Because of the potential for an obstruction (102), a drifting operation may be performed on the well (108) prior to deployment of operationally-required tools (such as completion tools, workover tools, running tools, etc.) into the well (108). It is important to drift a well (108) prior to running other more-complex tools into the well (108) because running tools into a well (108) that may have an obstruction (102) may cause the tools to be stuck or damaged.

As such, it is beneficial to drift the well (108) using a cheaper/less-complex drifting tool that is easily recoverable and less-easily damageable, when compared to the operationally-required tools. In accordance with one or more embodiments, drifting includes running a gauge cutter drift tool, having a diameter assumed to be the accessible inner diameter of the inner-most tubular (106), through the inside of the tubular (106) to determine the accessibility. In other embodiments, the gauge cutter drift tool may have an outer diameter larger than an outer diameter of a bottom hole assembly that is planned to be run into the well (108).

The gauge cutter drift tool may be unable to be run through the entirety of the tubular (106) due to the obstruction (102). When such scenarios occur, the apparatus (118) may be run into the well (108). The apparatus (118) may be used to both obtain a sample of the obstruction (102) and obtain an impression of the obstruction (102). The sample and impression of the obstruction (102) may be analyzed at the surface to determine what kind of obstruction (102) is downhole and what methods and tools should be implemented to clear the obstruction (102) from the well (108). The apparatus (118) is shown having two different configurations outlined below in FIG. 2 and FIG. 3.

Figure 2:
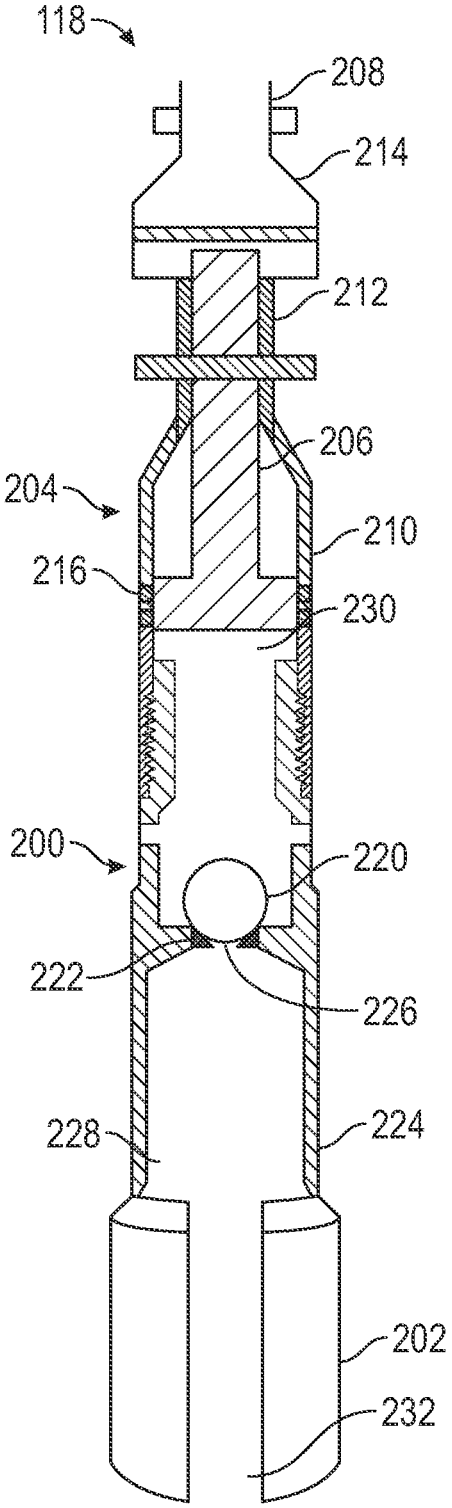
FIG. 2 shows the apparatus having a ball valve in accordance with one or more embodiments.

FIG. 2 shows the apparatus (118) having a ball valve (200) in accordance with one or more embodiments. Specifically, the apparatus (118) includes a lead impression block (LIB) connected to a sand bailer (204) that is operable using, in part, the ball valve (200). In accordance with one or more embodiments, the sand bailer (204) is a pump action type bailer that is designed to remove sand and debris (such as samples of the obstruction (102)) from the tubular (106) through an upward stroking motion of a piston (206).

In accordance with one or more embodiments, the sand bailer (204) includes a fishneck (208), a rod stopper (214), a stroke rod (212), a piston (206), a barrel (210), and a ball valve (200). The fishneck (208) is used to connect the apparatus to the deployment device (116). The fishneck (208) may also be used to interact with a fishing tool in order to remove the apparatus (118) from the well (108) if the apparatus (118) parts from the deployment device (116) or is stuck in the well (108).

When the upward stroking motion of the piston (206) is performed, a suction pressure is created inside the barrel (210) of the sand bailer (204). The suction pressure causes an influx of adjacent wellbore fluid and/or sand/debris from the obstruction (102) to flow into the barrel (210).

The upward stroking motion may be initiated by setting down on the obstruction (102) or by sending an electronic or hydraulic signal along the deployment device (116) without departing from the scope of the disclosure herein. Herein, the terms up/upwards/above/top is relative to a direction going from the ball valve (200) towards the fishneck (208), and down/below/under/beneath is relative to a direction going from the fishneck (208) towards the ball valve (200).

In accordance with one or more embodiments, the apparatus (118) is slowly lowered onto the obstruction (102) until jars (not pictured) have completely closed, and the piston (206) is in a down position. At this point, the apparatus (118) may be lifted up off of the obstruction (102) to activate the jars to stroke the piston (206) upward, create the suction pressure within a cavity (230) of the barrel (210), and cause an influx of wellbore fluid and/or samples of the obstruction (102) into the cavity (230) of the barrel (210). The piston (206) may be stroked upward using the stroke rod (212) connected to the jars. The rod stopper (214) is used to stop the momentum of the stroke rod (212) in the upwards direction. The piston (206) may be located within the barrel (210) and may be sealed against the barrel (210) using one or more seals (216).

In accordance with one or more embodiments, the wellbore fluid and/or samples of the obstruction (102) are held within the cavity (230) of the barrel (210), unable to escape, using the ball valve (200). The ball valve (200) includes a ball (220), a ball seat (222), and a hollow body (224). When the suction pressure is created in the barrel (210), the ball (220) moves in an upward direction and off of the ball seat (222).

The ball seat (222) has an inlet (226) that hydraulically connects an orifice (228) of the hollow body (224) below the ball seat (222) to the cavity (230) in the barrel (210) above the ball seat (222). Thus, when the ball (220) is moved off of the ball seat (222), the inlet (226) is uncovered and the wellbore fluid and/or samples of the obstruction (102) may travel through the inlet (226) into the cavity (230) of the barrel (210) from the orifice (228) below.

Once the pressure equalizes within the barrel (210), the suction pressure is reduced, and the ball (220) falls back onto the ball seat (222) to cover the inlet (226). Thus, the wellbore fluids and/or samples of the obstruction (102) are trapped within the cavity (230) in the barrel (210). At this point, the apparatus (118) may be pulled to the surface and the sample of the obstruction (102) may be removed from the barrel (210) and analyzed.

In accordance with one or more embodiments, a LIB (202) is connected to the hollow body (224) of the ball valve (200). In accordance with one or more embodiments, to create the LIB (202), the shoe of the ball valve (i.e., the downhole-most end of the hollow body (224)) may be filled with lead and a pathway (232) may be formed into the center of the LIB (202).

In other embodiments, the LIB (202) may be a separate sub manufactured having a lead block at the bottom of the sub. A pathway (232) may also be manufactured through the center of the sub such that the orifice (228) of the hollow body (224) is in fluidic connection with an external environment of the apparatus (118) (e.g., the interior of the tubular (106) when the apparatus (118) is run into the tubular (106)). The sub may be connected to the downhole-most end of the hollow body (224) of the ball valve (200) using any type of connection known in the art, such as a threaded connection, a welded connection, a bolt/flange connection, etc.).

The lead in the LIB (202) is soft enough such that when the apparatus (118) lands on the obstruction (102), the lead is able to take an impression of the obstruction (102). When the apparatus (118) is brought to the surface, the impression in the LIB (202) may be analyzed to determine the extent/shape of the obstruction (102) and how to efficiently remove the obstruction (102) from the well (108). After the LIB (202) has taken one impression, the lead in the LIB (202) may be redressed so that the apparatus (118) may be run again into the same well (108) or into a different well.

With the apparatus (118) having both a sand bailer (204) and a LIB (202), the apparatus (118) can take in samples of the obstruction (102) as well as take an impression of the obstruction (102) on the same run. This saves time and allows the obstruction (102) to be dealt with more effectively. It is important that the obstruction (102) be removed efficiently because the less time spent on a well (108) reduces the likelihood of wellbore incidents. How to deal with the obstruction (102) depends on the cause/type of the obstruction (102) and may include a cleanout method or fishing operation without departing from the scope of the disclosure herein.

Figure 3:
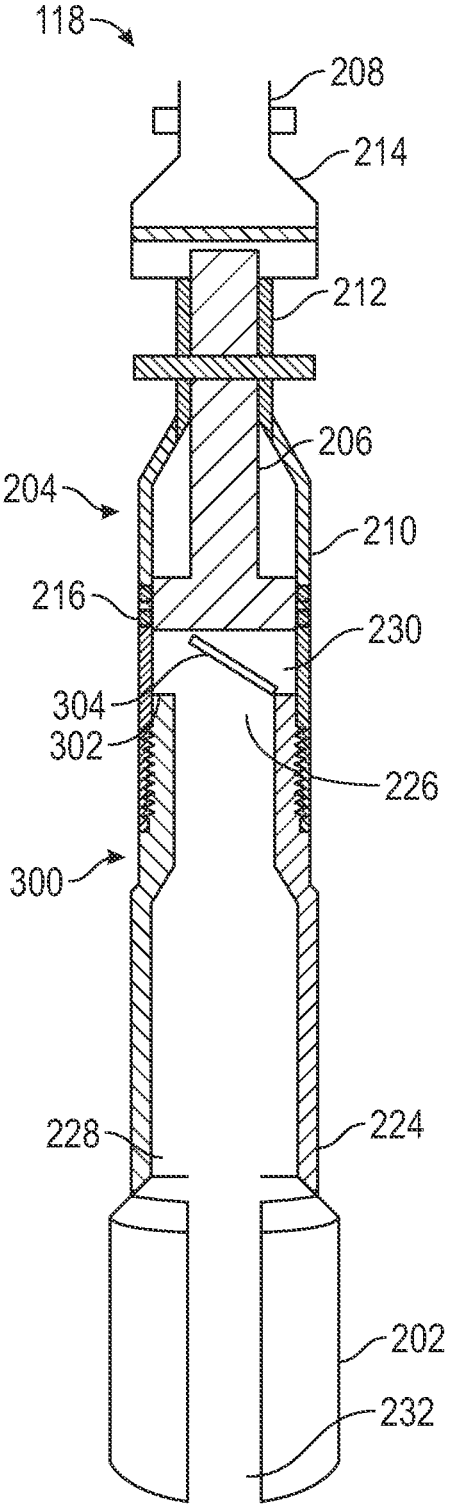
FIG. 3 shows the apparatus having a flapper valve in accordance with one or more embodiments.

FIG. 3 shows the apparatus (118) having a flapper valve (300) in accordance with one or more embodiments. Components shown in FIG. 3 that are the same as or similar to components shown in FIGS. 1 and 2 have not been re-described for purposes of readability and have the same description and function as outlined above.

In accordance with one or more embodiments, the apparatus (118) shown in FIG. 3 is substantially the same as the apparatus (118) shown in FIG. 2, except for the valve. In FIG. 2, the sand bailer (204) of the apparatus (118) is operable using the ball valve (200). In FIG. 3, the sand bailer (204) of the apparatus (118) is operable using a flapper valve (300).

As such, FIG. 3 shows a LIB (202) connected to a sand bailer (204) via the flapper valve (300). The LIB (202) is connected to the flapper valve (300) in a similar manner to how the LIB (202) is connected to the ball valve (200), outlined above. The apparatus (118) having both the LIB (202) and the sand bailer (204) allows the apparatus (118) to take both an impression of the obstruction (102), using the LIB (202), and a sample of the obstruction (102), using the sand bailer (204). Specifically, the sand bailer (204) receives an influx of wellbore fluid and/or samples of the obstruction (102), as outlined above.

In accordance with one or more embodiments, the wellbore fluid and/or samples of the obstruction (102) are held within the cavity (230) of the barrel (210), unable to escape, using the flapper valve (300). The flapper valve (300) includes a hollow body (224) having an orifice (228), a flapper seat (302) having an inlet (226), and a flapper (304) configured to cover and uncover the inlet (226).

In accordance with one or more embodiments, the flapper (304) is connected to the flapper seat (302) on one end using a hinge or a spring. This leaves the other end unconnected to the flapper seat (302). As such, the flapper (304) is able to open (i.e., move away from the flapper seat (302)) when a pressure is applied to the flapper (304) in an upwards direction and close (i.e., press against the flapper seat (302)) when a pressure is applied to the flapper (304) in a downwards direction. Thus, when the suction pressure is created in the barrel (210), a pressure is applied in an upwards direction on the flapper (304) and the flapper (304) moves off of the flapper seat (302).

The inlet (226) of the flapper seat (302) hydraulically connects the orifice (228) of the hollow body (224) below the flapper seat (302) to the cavity (230) in the barrel (210) above the flapper seat (302). Thus, when the flapper (304) opens and uncovers the inlet (226), the wellbore fluid and/or samples of the obstruction (102) may travel through the inlet (226) into the cavity (230) of the barrel (210) from the orifice (228) below.

Once pressure equalized within the barrel (210), the suction pressure is reduced, and the flapper moves to cover the flapper seat (302) to cover the inlet (226). This, the wellbore fluids and/or samples of the obstruction (102) are trapped within the cavity (230) in the barrel (210). At this point, the apparatus (118) may be pulled to the surface and the sample of the obstruction (102) may be removed from the barrel (210) and analyzed.

Figure 4:
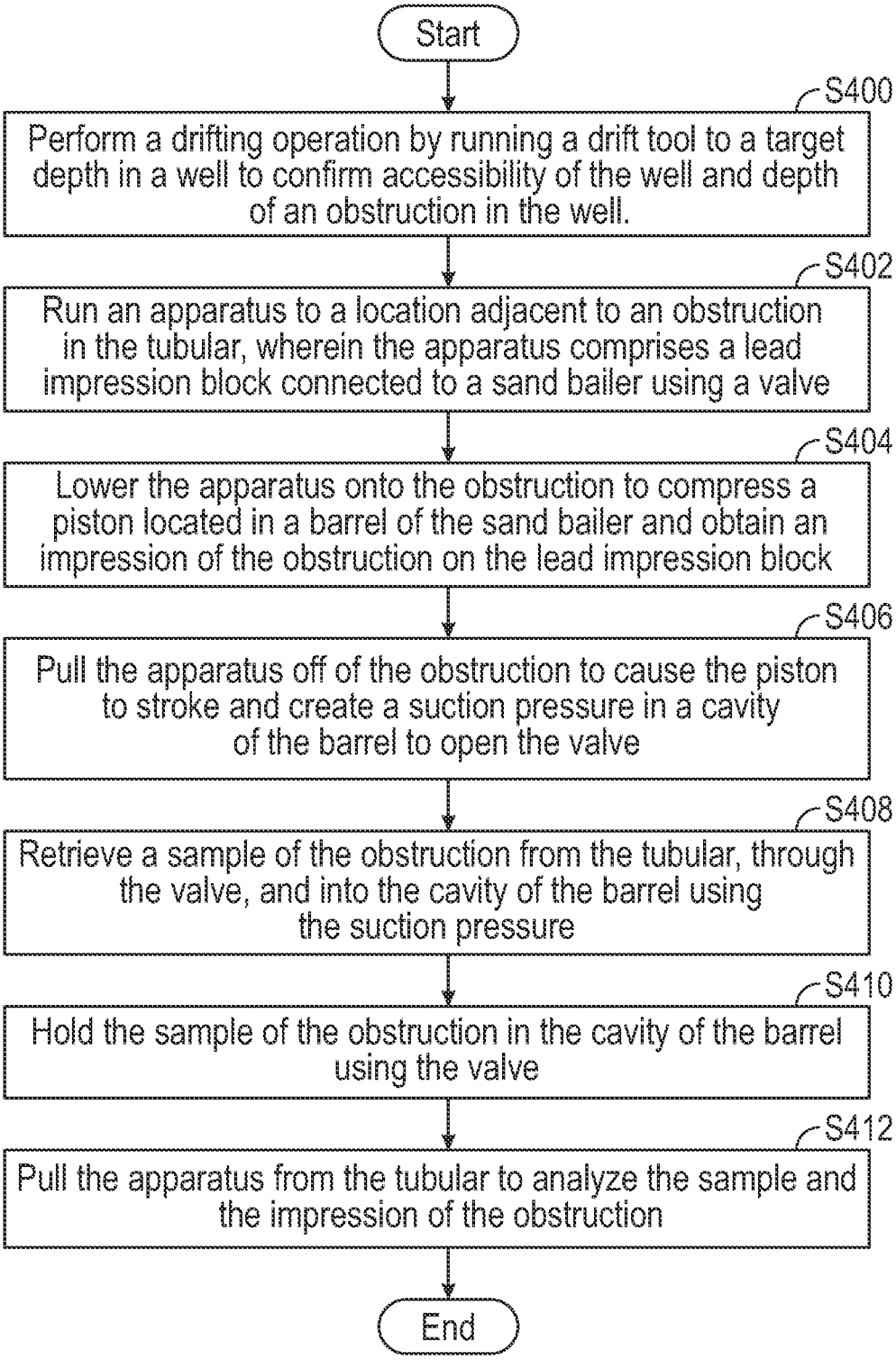
FIG. 4 shows a flowchart in accordance with one or more embodiments.

FIG. 4 shows a flowchart in accordance with one or more embodiments. The flowchart outlines a method for detecting an obstruction (102) in a tubular (106). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S400, a drifting operation is performed by running a drift tool to a target depth in a well (108) to confirm accessibility of the well (108) and depth of an obstruction (102) in the well (108). In accordance with one or more embodiments, wells that have known stop points (i.e., a tool has been run into the well (108) and the tool has gotten stuck), wells that have decreased performance, or wells that have been on production for years may require a drifting operation to be performed prior to running any other tools into a tubular (106) in the well (108). The drifting operation allows the operator to know if there is an obstruction (102) in the well (108) and if it would be un-safe to run subsequent tools into the well (108). An example drifting operational sequence is outlined herein, but a person skilled in the art will appreciate that any drifting operational sequence may be used without departing from the scope of the disclosure herein.

To begin the drifting operation, a slickline unit, a crown/swab valve adapter spool, and pressure control equipment (such as lubricators and blow-out preventors) having the required pressure rating are rigged up on the production tree (114) of the well (108) and are pressure tested according to operational barrier requirements. A bottom hole assembly (BHA) is made up along with a gauge cutter drift tool.

The gauge cutter may be sized to "full-bore size," which may be equivalent to the known minimum inner diameter of the tubular (106). As outlined above, the objective of the gauge cutter is to confirm wellbore accessibility either prior to running any downhole tool, e.g., plugs, perforation guns, gauges, logging tools, etc., or as a part of wellbore accessibility diagnostic operations for a low performance well.

Prior to running the gauge cutter in the well (108), all BHA components are calipered and the dimensions (including outer diameters and lengths) are recorded. To run the gauge cutter in the well (108), the tool string, including the BHA and gauge cutter, are picked up and lowered into the lubricator.

Pressure between the well (108) and the tool string is equalized across the tool string within the lubricator. Specifically, pressure is bled to the shut-in wellhead pressure to equalize across the master valve. Once pressure is equalized, the master valve is opened, and a fusible lockout cap may be installed on the surface safety valve/hydraulic mater valve to avoid accidental closure of the hydraulic valve during slickline operations.

The gauge cutter may then be run into the tubular (106). The gauge cutter may be lowered to a target depth in the well (108) to determine if there are any obstructions (102). The target depth may be the absolute bottom of the well (108), or the target depth may be the depth in the well that the future tools will be run to in the subsequent operations. If there is a known stop point/obstruction (102), the gauge cutter may be lowered to a depth adjacent to the stop point/obstruction (102). In further embodiments, the gauge cutter may be run to a depth 100 feet up-hole from the assumed depth of the top of the stop point/obstruction (102).

The tool string may be slowly lowered to the depth of the stop point/obstruction (102) to tag the obstruction (102). The tag may be analyzed to be a soft tag or a hard tag. If the gauge cutter does not tag anything at the depth of the stop point/obstruction (102), the gauge cutter may be lowered completely through the well (108) to ensure there are no obstructions (102) in the well (108).

If previous operations had encountered a stop point or a tight spot, and that is why the drifting operation is being performed, but the gauge cutter does not tag an obstruction (102), then the stop point/tight spot may be attributed to high wellbore deviation. If the gauge cutter does tag an obstruction (102) in the well (108), then the apparatus (118) may be run into the well (108) to analyze the obstruction (102), diagnose the obstruction (102), and determine how to remove the obstruction (102).

The tool string having the gauge cutter must be removed prior to running the apparatus (118) into the well (108). Specifically, the tool string may be pulled up to a depth 100 feet below the mater valve. At this point, the tool string may be slowly raised into the lubricator while the weight indicator is monitored.

Once the tool string is in the lubricator, the swab/crown valve may be closed. Pressure may be equalized between the tool string and the atmosphere, and the tool string may be removed from the lubricator. Once removed, the gauge cutter tool may be disassembled from the BHA of the tool string and the apparatus (118) may be installed in the BHA of the tool string.

The apparatus (118) may be function tested by checking the piston (206) for stroke movement within the barrel (210). All connections may be checked and tightened, and the LIB (202) may be checked for any impression. Pictures of the face and side of the LIB (202) may be taken before and after each run for comparison.

In S402, the apparatus (118) is run to a location adjacent to an obstruction (102) in the tubular (106). The apparatus (118) comprises a LIB (202) connected to a sand bailer (204) using a valve. In accordance with one or more embodiments, the LIB (202) may be connected to the sand bailer (204) by filling lead into a shoe of the valve to create a lead-filled shoe. A pathway (232) may also be formed through the lead-filled shoe. In other embodiments, the LIB (202) may be a separate sub having a lead block and a pathway (232) formed through the lead block. The separate sub may be connected to a hollow body (224) of the valve in the sand bailer (204) using any connection known in the art, such as a threaded connection.

In accordance with one or more embodiments, the apparatus (118) may be lowered into the well (108) through the lubricator using the same techniques as outlined above with respect to the gauge cutter. In accordance with one or more embodiments, the apparatus (118) is lowered at moderate speed so as to not damage the sides of the LIB (202) or sand bailer (204). As the apparatus (118) is close to the expected depth of the obstruction (102) (e.g., 100 feet away), the speed of the apparatus (118) being lowered is slowed.

The apparatus (118) is stopped around 10-20 feet above/up-hole from the obstruction (102). At this depth, the apparatus (118) is pulled 25 feet up to record the weight of the tool string. In S404, the apparatus (118) is lowered onto the obstruction (102) to compress a piston (206) located in a barrel (210) of the sand bailer (204) and obtain an impression of the obstruction (102) on the LIB (202).

In accordance with one or more embodiments, the apparatus (118) is slowly lowered onto the obstruction (102) until the jars in the apparatus (118) have closed and the piston (206) is in the down position. The weight reductions of the tool may be recorded when the apparatus (118) tags the obstruction (102) and when the jars are closed/the piston (206) is in the down position. As the apparatus (118) is lowered onto the obstruction (102), the LIB (202) takes an impression of the obstruction (102).

In S406, the apparatus (118) is pulled off of the obstruction (102) to cause the piston (206) to stroke and create a suction pressure in a cavity (230) of the barrel (210) to open the valve. In S408, a sample of the obstruction (102) is retrieved from the tubular (106), through the valve, and into the cavity (230) of the barrel (210) using the suction pressure. In S410, the sample of the obstruction (102) is held in the cavity (230) of the barrel (210) using the valve.

The valve may be the ball valve (200) outlined in FIG. 2 or the flapper valve (300) outlined in FIG. 3 without departing from the scope of the disclosure herein. In accordance with one or more embodiments, when the suction pressure is created in the cavity (230) of the barrel (210), the ball (220) is moved off of the ball seat (222) or the flapper (304) is moved away from the flapper seat (302) to uncover the inlet (226) in the ball seat (222)/flapper seat (302).

Once the inlet (226) is uncovered, hydraulic communication is able to occur between the orifice (228) of the hollow body (224) and the cavity (230) of the barrel (210). The hydraulic communication allows the suction pressure to pull in the adjacent wellbore fluids and/or samples of the obstruction (102) from the tubular (106), through the pathway (232) in the LIB (202), into the orifice (228) of the hollow body (224), through the inlet (226) in the valve, and into the cavity (230) of the barrel (210). Once the pressure is equalized in the cavity (230), the ball (220) falls down to land against the ball seat (222) or the flapper (304) is pushed against the flapper seat (302) to block the inlet (226) and hold the sample of the obstruction (102) in the cavity (230) of the barrel (210).

In S412, the apparatus (118) is pulled from the tubular (106) to analyze the sample and the impression of the obstruction (102). In accordance with one or more embodiments, the apparatus (118) may be pulled out of the well (108) through the lubricator using the same techniques as outlined above with respect to the gauge cutter. Once the apparatus (118) is at the surface, the sample and the impression of the obstruction (102) may be analyzed to diagnose the cause of the obstruction (102), determine the make-up of the obstruction (102), and determine a method for removing or mitigating the obstruction (102). Prior to opening the sand bailer (204), safety precautions should be taken for any trapped pressure inside the cavity (230) of the barrel (210).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An apparatus for detecting an obstruction in a tubular, the apparatus comprising:

a sand bailer configured to be disposed in the tubular and obtain a sample of the obstruction, the sand bailer comprising:

a piston movably disposed in a cavity of a barrel; and a valve connected to a downhole end of the barrel and configured to control hydraulic communication between an orifice of a hollow body of the valve and a cavity of the barrel by opening and closing, wherein the piston is configured to create a suction pressure in the cavity of the barrel to open the valve and retrieve the sample of the obstruction into the cavity and wherein the valve is configured to close to hold the sample of the obstruction in the cavity of the barrel; and a lead impression block connected to the hollow body of the valve in the sand bailer, wherein the lead impression block is configured to set against the obstruction, using the sand bailer, and obtain an impression of the obstruction, and wherein the lead impression block comprises lead filled into a shoe of the valve to create a lead-filled shoe and a pathway formed into a center of the lead-filled shoe.

2. The apparatus of claim 1, wherein the valve further comprises a ball valve.

3. The apparatus of claim 2, wherein the ball valve comprises the hollow body having the orifice, a ball seat having an inlet, and a ball.

4. The apparatus of claim 3, wherein the ball is configured to move off of the ball seat, toward the piston, when the suction pressure is created in the cavity of the barrel to uncover the inlet of the ball seat and create hydraulic communication between the orifice of the hollow body and the cavity of the barrel.

5. The apparatus of claim 1, wherein the valve further comprises a flapper valve.

6. The apparatus of claim 5, wherein the flapper valve comprises the hollow body having the orifice, a flapper seat having an inlet, and a flapper.

7. The apparatus of claim 6, wherein the flapper is configured to uncover the inlet in the flapper seat by moving towards the piston when the suction pressure is created in the cavity to create hydraulic communication between the orifice of the hollow body and the cavity of the barrel.

8. A method for detecting an obstruction in a tubular, the method comprising:

running an apparatus to a location adjacent to an obstruction in the tubular, wherein the apparatus comprises a lead impression block connected to a sand bailer using a valve, wherein the lead impression block comprises lead filled into a shoe of the valve to create a lead-filled shoe and a pathway formed into a center of the lead-filled shoe;

lowering the apparatus onto the obstruction to compress a piston located in a barrel of the sand bailer and obtain an impression of the obstruction on the lead impression block;

pulling the apparatus off of the obstruction to cause the piston to stroke and create a suction pressure in a cavity of the barrel to open the valve;

retrieving a sample of the obstruction from the tubular, through the valve, and into the cavity of the barrel using the suction pressure;

holding the sample of the obstruction in the cavity of the barrel using the valve; and pulling the apparatus from the tubular to analyze the sample and the impression of the obstruction.

9. The method of claim 8, wherein the valve further comprises a ball valve.

10. The method of claim 9, wherein the ball valve comprises a hollow body having an orifice, a ball seat having an inlet, and a ball.

11. The method of claim 10, wherein retrieving the sample of the obstruction further comprises moving the ball off of the ball seat, toward the piston, using the suction pressure to uncover the inlet of the ball seat and create hydraulic communication between the orifice of the hollow body and the cavity of the barrel.

12. The method of claim 8, wherein the valve further comprises a flapper valve.

13. The method of claim 12, wherein the flapper valve comprises a hollow body having an orifice, a flapper seat having an inlet, and a flapper.

14. The method of claim 13, wherein retrieving the sample of the obstruction further comprises moving the flapper off of the flapper seat towards the piston using the suction pressure to uncover the inlet of the flapper seat and create hydraulic communication between the orifice of the hollow body and the cavity of the barrel.

* * * * *